United States Patent [19]

Lambers et al.

[11] Patent Number: 4,843,949

[45] Date of Patent: Jul. 4, 1989

[54] FLUID CONTROL VALVE WITH VARIABLE PRESSURE GAIN

[75] Inventors: Howard J. Lambers; Michael D. Herder; Richard P. Heintz, all of Kalamazoo, Mich.

[73] Assignee: Pneumo Abex Corporation, Boston, Mass.

[21] Appl. No.: 237,081

[22] Filed: Aug. 29, 1988

[51] Int. Cl.[4] ..... F15B 13/04

[52] U.S. Cl. ..... 91/437; 91/509; 137/596

[58] Field of Search ..... 91/437, 509, 510; 137/596

[56] References Cited

U.S. PATENT DOCUMENTS 3,541,927 11/1970 Iijima ..... 91/437 X
3,561,322 2/1971 Gerstine et al. ..... 91/437 X
3,942,550 3/1976 Orme ..... 137/493

*Primary Examiner*—Gerald A. Michalsky
*Attorney, Agent, or Firm*—Renner, Otto, Boisselle & Sklar

[57] ABSTRACT

Actuator control system includes two parallel connected orifices between a pair of fluid passages providing communication between an actuator and a flow control valve. Relief valves in series with the respective orifices block fluid flow through the orifices at low differential pressures between the fluid passages, thereby preserving the original high pressure gain of the control valve in a region about valve null. At higher differential pressures outside the valve null region, the relief valves open to permit restricted flow through the respective orifices to reduce the pressure gain of the control valve in a region outside the valve null region, which effectively reduces the stiffness of the control valve.

10 Claims, 1 Drawing Sheet

FLUID CONTROL VALVE WITH VARIABLE PRESSURE GAIN

BACKGROUND OF THE INVENTION

This invention relates generally as indicated to a fluid control valve with variable pressure gain, and more particularly, to an actuator control system which preserves the original high pressure gain of the control valve about the valve null region to meet actuator threshold requirements and reduces the pressure gain outside the valve null region. Such control valves are especially intended for use in reducing opposing forces between two or more separate, independent actuators attached to a single aircraft flight control system or the like.

It is common practice to provide flight control systems for aircraft with redundant flight control actuators so that in the event one of the actuators should fail or shut down, the systems are still capable of properly functioning using the remaining actuator or actuators. Opposing forces (hereinafter referred to as "fight forces") between such redundant flight control actuators have generally been controlled with the use of tandem, synchronized control valves, or mechanical or electrical detection and feed back correction of the force flight between actuators. However, most feed back concepts cannot be used for this purpose when two or more separate, independent actuators are used to control the movements of a single aircraft flight control surface in that cross-channel information regarding force flights cannot be shared between independent actuators.

One recognized way of reducing or controlling force fights between separate, independent actuators is to provide an orifice between the load control passages leading from the control valve to the actuator to reduce the pressure gain of the actuator control valve. This effectively reduces the stiffness of the control valve and thereby reduces actuator force fights. However, this also lowers the pressure gain about the valve null region, which has the undesirable effect of decreasing the ability of the control valve to move the actuator with very small input commands to meet actuator threshold requirements.

SUMMARY OF THE INVENTION

With the foregoing in mind, it is a principal object of this invention to provide an actuator control system which preserves the original high pressure gain of the control valve in a region about the valve null position to meet actuator threshold requirements and provides a lower pressure gain in a region outside the valve null region to reduce force fights between two or more separate, independent actuators used to control the movements of a single flight control surface or the like.

These and other objects of the present invention may be accomplished by providing two parallel, fixed orifices between the motor ports of a fluid control valve, with relief valves in series with the respective orifices to block fluid flow through the orifices at low differential pressures, thereby preserving the original high pressure gain of the control valve in a region about the null position and reducing the control valve pressure gain outside the valve null region to reduce the stiffness of the control valve and thereby reduce actuator force fights. The relief valve cracking pressure should be set above that required for actuator threshold requirements so that the relief valves will not open to permit restricted flow through the respective orifices causing a reduction in pressure gain of the control valve until the control valve is outside the valve null region.

Also according to the invention, the resultant pressure gain of the control valve is variable depending on the orifice size and relief valve cracking pressure.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
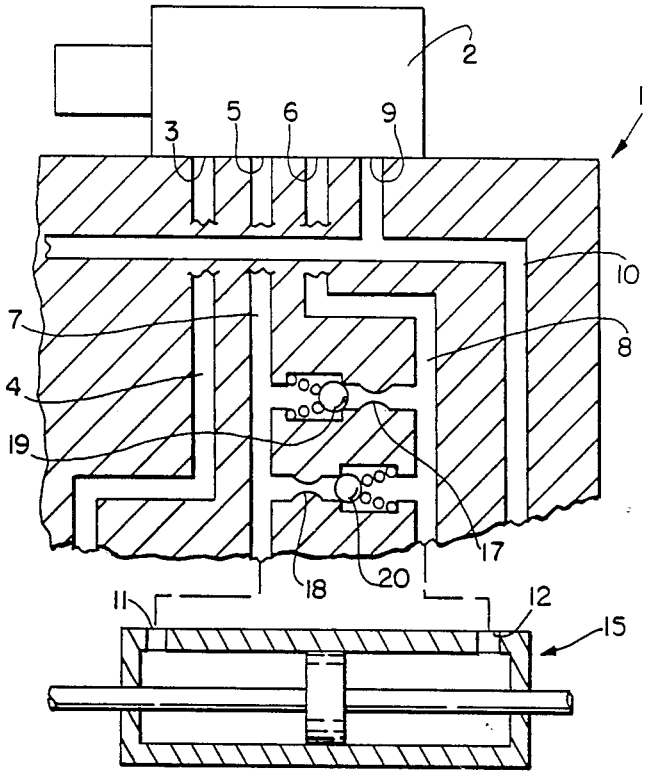
FIG. 1 is a fragmentary schematic sectional view through a preferred form of actuator control system including a fluid control valve with variable pressure gain according to the present invention.

Referring now in detail to the drawings, and initially to FIG. 1, there is schematically shown an actuator control system 1 according to this invention including a control valve 2 of suitable type such as a two-stage electro-hydraulic valve having various fluid passages connected to the respective ports thereof. In the embodiment disclosed herein, the control valve 2 includes a pressure inlet port 3 in communication with a fluid pressure supply passage 4, a pair of motor ports 5, 6 in communication with a pair of load control passages 7, 8, and a return port 9 in communication with a return passage 10. The fluid pressure supply passage 4 will of course be connected to a suitable source of high pressure hydraulic fluid and the return passage 10 connected to a fluid reservoir (not shown), whereas the load control passages 7, 8 are shown connected to the load control ports ll, 12 of a fluid actuator 15.

The control valve 2 may be actuated in known manner for example between a valve null position in which fluid flow to and from the load control passage 7, 8 is blocked and eiher of two operating positions in which one of the load control passages 7, 8 is connected to the fluid pressure supply passage 4 and the other is connected to the return passage 10 or vice versa for controlling the flow of fluid to fluid actuator 15. In applications where two or more separate, independent actuators 15 are mounted side-by-side and attached to a single aircraft flight control surface to control the movements thereof, force fights will occur between such actuators. The actuator control system 1 of the present invention independently reduces (controls) such force flights between actuators by providing communication between the load control passages 7, 8 of each actuator control system through a pair of fixed orifices 17, 18 in parallel with each other to reduce the pressure gain of the actuator control valve 2. However, fluid flow through the respective orifices 17, 18 is blocked at low differential pressures by providing pressure relief valves 19, 20 in series with the respective orifices 17, 18. Such relief values 19, 20 preserve the original high pressure gain of the control valve 2 about the null position, thus giving the control valve 2 the ability to move the actuator 15 with very small input commands about the valve null position to meet actuator threshold requirements.

Relief valve 19 is oriented to permit fluid flow between load control passages 7, 8 through its associated orifice 17 only when the differential pressure in the load control passage 8 exceeds the cracking pressure of the relief valve 19. Conversely, relief valve 20 is oriented to permit such flow through its associated orifice 18 only when the differential pressure in the load control passage 7 exceeds the relief valve cracking pressure, which in both cases is desirably set just above the actuator threshold requirements. For example, if ±100 psid is required for actuator threshold requirements, the relief valve cracking pressure for both relief valves 19, 20, would be set at 120 psid. In that event, actuator load differential pressure above 120 psid will cause the appropriate relief valve 19 or 20 to open fully, thereby causing a reduction in pressure gain of the actuator control valve 2 above such cracking pressure. This effectively reduces the stiffness of the actuator control valve 2, thereby reducing actuator force fights.

Figure 2:
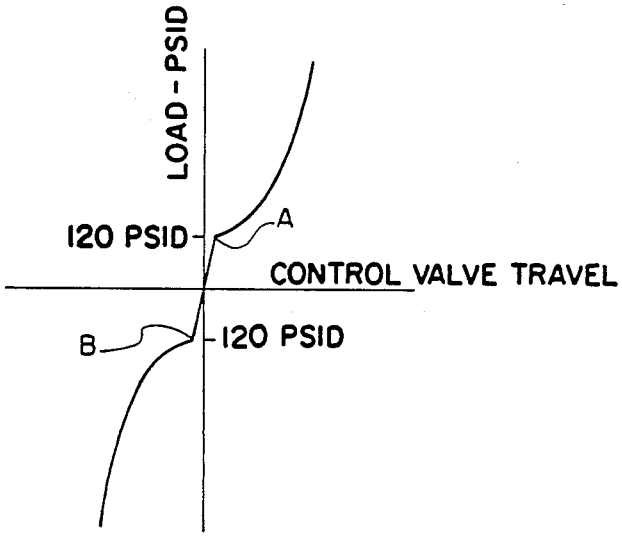
FIG. 2 is a typical pressure gain plot curve for the control valve of FIG. 1.

The resultant pressure gain of the actuator control valve 2 is variable depending on the size of the orifices 17, 18 and the cracking pressure of the relief valves 19, 20. An example of a typical pressure gain plot for an actuator control valve 2 according to the present invention is schematically shown in FIG. 2. As illustrated, the original high pressure gain of the control valve 2 is preserved in a region about the valve null position between points A and B by the closed relief valves 19, 20. However, as soon as the actuator load differential pressure exceeds the cracking pressure of either of the relief valves 19, 20, which in this example is 120 psid, the pressure gain of the control valve 2 outside the valve region defined by points A and B is controlled by the associated orifices 17, 18 which initially cause a reduction in pressure gain of the control valve where the pressure gain is initially relatively flat and then increases with a square law effect. In this way, the relief valves 19, 20 improve the threshold of the control valve 2 by masking the normal relatively flat spot of the orifices 17, 18 in the null region.

From the foregoing, it will now be apparent that the actuator control system of the present invention preserves the original high pressure gain of the actuator control valve about the null position to meet actuator threshold requirements and reduces the control valve pressure gain outside such actuator threshold requirements to effectively reduce the stiffness of the control valve and thereby reduce actuator force fights.

Although the invention has been shown and described with respect to a certain preferred embodiment, it is obvious that equivalent alterations and modifications will occur to others skilled in the art upon the reading and understanding of the specification. The present invention includes all such alterations and modifications, and is limited only by the scope of the claims.

What is claimed is:

1. In an actuator control system, a pair of fluid passages providing fluid flow to and from an actuator, flow control valve means for controlling such fluid flow through said fluid passages, orifice means permitting restricted flow between said fluid passages, and relief valve means in series with said orifice means for blocking fluid flow through said orifice means at low differential pressures between said fluid passages and permitting restricted flow through said orifice means at higher differential pressures between said fluid passages, said relief valve means being set to open at differential pressures below said higher differential pressures.

2. The system of claim 1 wherein there are two of said orifice means connected in parallel between said fluid passages, and two of said relief valve means in series with said orifice means, one of said relief valve means permitting restricted fluid flow through one of said orifice means when said higher differential pressures exist in one of said fluid passages, and the other of said relief valve means permitting restricted fluid flow through the other of said orifice means when said higher differential pressures exist in the other of said fluid passages.

3. The system of claim 2 wherein said control valve means includes a valve null position for blocking fluid flow through said fluid passages, said control valve means being operable to provide such low differential pressures between said fluid passages in a region about such valve null position and such higher differential pressures in said fluid passages outside such region, and said relief valve means blocking fluid flow through said orifice means at such low differential pressures to preserve the original high pressure gain of said control valve means in such region about the valve null position to meet actuator threshold requirements, and permitting restricted fluid flow through said orifice means at such higher differential pressures between said fluid passages to reduce the pressure gain of said flow control valve means outside such region.

4. The system of claim 3 wherein said relief valve means is set to open just above the actuator threshold requirements to permit restricted flow through said orifice means at such higher differential pressures between said fluid passages.

5. An actuator control system comprising a fluid actuator, flow control valve means for controlling fluid flow to and from said actuator through a pair of flow passages communicating said actuator with said flow control valve means, said flow control valve means being operable to provide low differential pressures between said fluid passages about a valve null position and higher differential pressures between said fluid passages in a region outside such valve null position, orifice means for providing restricted flow between said flow passages, and means for blocking such fluid flow through said orifice means at such low differential pressures between said fluid passages to preserve the original high pressure gain of said control valve means about such valve null position to meet actuator threshold requirements and for permitting restricted fluid flow through said orifice means at higher differential pressures between said flow passages to reduce the pressure gain of said control valve means at such higher differential pressures.

6. The system of claim 5 wherein said last-mentioned means comprises relief valve means in series with said orifice means.

7. The system of claim 6 wherein said relief valve means is set to open just above such actuator threshold requirements.

8. The system of claim 6 wherein there are two parallel connected orifice means between said fluid passages, and relief valve means in series with each of said orifice means for respectively blocking and permitting restricted flow through one or the other of said orifice means when such higher differential pressures exist in one or the other of said fluid passages.

9. The system of claim 6 wherein said relief valve means is set to open at differential pressures between said low and higher differential pressures.

10. The system of claim 9 wherein said relief valve means is set to open at differential pressures just above such low differential pressures.

* * * * *